US008083922B2

(12) United States Patent
Orikasa et al.

(10) Patent No.: US 8,083,922 B2
(45) Date of Patent: Dec. 27, 2011

(54) TIN ELECTROLYTIC PLATING SOLUTION FOR ELECTRONIC PARTS, METHOD FOR TIN ELECTROLYTIC PLATING OF ELECTRONIC PARTS, AND TIN ELECTROPLATED ELECTRONIC PARTS

(75) Inventors: Makoto Orikasa, Gunma (JP); Toshiaki Makino, Gunma (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 662 days.

(21) Appl. No.: 12/184,138

(22) Filed: Jul. 31, 2008

(65) Prior Publication Data

US 2009/0061241 A1 Mar. 5, 2009

(30) Foreign Application Priority Data

Aug. 1, 2007 (JP) ..... 2007-200572

(51) Int. Cl.
*C25D 3/30* (2006.01)
*C25D 3/32* (2006.01)
*C23C 16/40* (2006.01)

(52) U.S. Cl. ..... 205/303; 205/300; 205/302; 106/1.25

(58) Field of Classification Search ..... 205/300, 205/302, 303; 106/1.25
See application file for complete search history.

(56) References Cited

U.S. PATENT DOCUMENTS

| | | | | |
|---|---|---|---|---|
| 4,347,107 | A * | 8/1982 | Teichmann et al. | 205/241 |
| 4,459,185 | A * | 7/1984 | Obata et al. | 205/254 |
| 5,326,453 | A * | 7/1994 | Endicott et al. | 205/50 |
| 6,607,653 | B1 * | 8/2003 | Tsuji et al. | 205/241 |
| 6,911,138 | B2 | 6/2005 | Motoki et al. | |
| 7,357,853 | B2 | 4/2008 | Toben et al. | |
| 2006/0096867 | A1 * | 5/2006 | Bokisa et al. | 205/253 |
| 2006/0113006 | A1 * | 6/2006 | Masuda et al. | 148/270 |

FOREIGN PATENT DOCUMENTS

| | | | |
|---|---|---|---|
| JP | 08-306584 | | 11/1996 |
| JP | 2001-240993 | A | 9/2001 |
| JP | 2003-082492 | A | 3/2003 |
| JP | 2003-293186 | A | 10/2003 |
| JP | 2005-060822 | A | 3/2005 |
| JP | 2006328528 | A * | 12/2006 |
| WO | 2003021008 | A | 3/2003 |
| WO | WO 2004065663 | A1 * | 8/2004 |

* cited by examiner

*Primary Examiner* — Edna Wong
(74) *Attorney, Agent, or Firm* — Law Office of Katsuhiro Arai

(57) ABSTRACT

A tin electrolytic plating solution comprises a suitably selected nonionic surfactant having a branched alkyl group. The nonionic surfactant is contained either alone, or with a suitably selected cationic surfactant and/or a suitably selected alkyl imidazole. The invention also provides a tin electrolytic plating method using such a tin electrolytic plating solution, and a tin electroplated electronic part obtained by such a method.

8 Claims, 1 Drawing Sheet

[Fig .1]
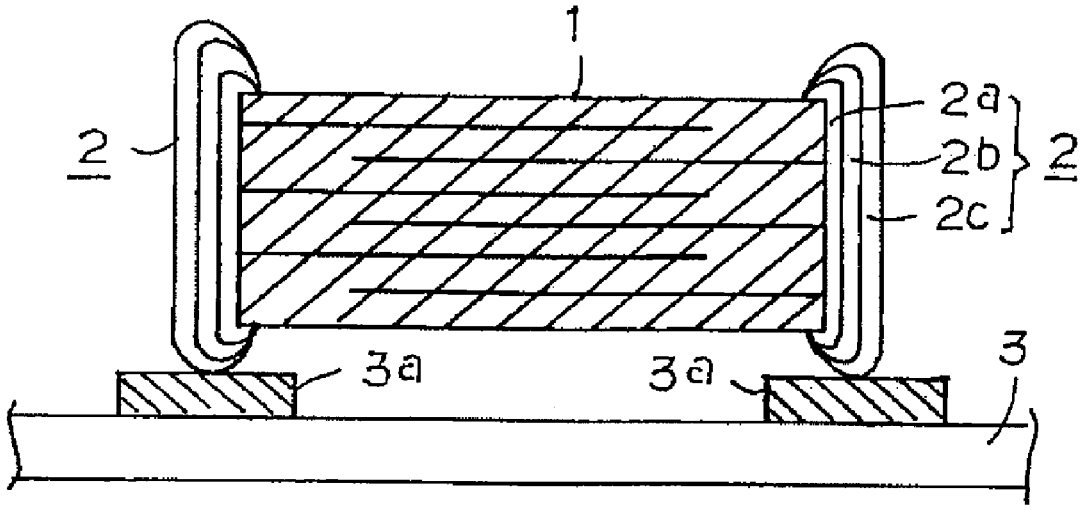
[Fig .2]
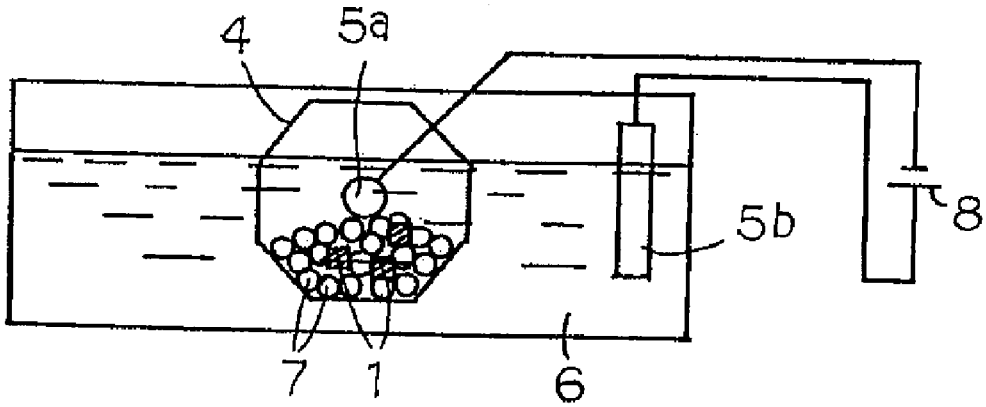

TIN ELECTROLYTIC PLATING SOLUTION FOR ELECTRONIC PARTS, METHOD FOR TIN ELECTROLYTIC PLATING OF ELECTRONIC PARTS, AND TIN ELECTROPLATED ELECTRONIC PARTS

CROSS REFERENCE TO RELATED APPLICATION

The present application hereby claims priority under 35 U.S.C. §119 on Japanese patent application number 2007-200572 filed Aug. 1, 2007, the entire contents of which are hereby incorporated by reference.

BACKGROUND OF THE INVENTION

1. Field of the Invention

The present invention relates to tin electrolytic plating solutions for electronic parts tin-plated for solder-mounting, use of such plating solutions, and tin electroplated electronic parts exploiting the properties of the tin electrolytic plating solutions.

2. Description of the Related Art

Ceramic electronic parts such as multilayer type ceramic capacitors, chip-shaped inductors, chip-shaped thermistors, chip-shaped LC composite parts, and various kinds of arrays have been used for surface mounting on circuit boards such as printed wiring boards.

For example, as shown in FIG. 1, a multilayer type ceramic capacitor, which is constructed from a ceramic element 1 and external connected electrodes 2, 2, is used by being soldered to solder lands 3*a*,3*a* of a circuit board 3. The ceramic element 1 includes successive layers of a dielectric substance and an internal electrode. The external connected electrodes 2, 2 are formed on both ends of the ceramic element 1.

The external connected electrodes for such electronic parts are generally formed by applying a conductive material paste, containing either Ag or Ag—Pd, onto the both ends of the ceramic element 1 and forming a conductor film 2*a* by a baking process, followed by formation of a Ni plating layer 2*b*, and then a tin (Sn)-containing plating layer (Sn plating layer) 2*c*, as shown in FIG. 1. The conductor film 2*a* is provided to enable the otherwise unworkable direct electrolytic plating on the ceramic element. However, because of the high price of Ag, the conductor film 2*a* is formed as thin as possible to reduce cost. The Ni plating layer 2*b* is provided as a barrier layer for the Sn-containing plating layer 2*c*, which, when directly formed on the conductor film 2*a*, causes the phenomenon known as "leaching," in which the Ag in the ground layer dissolves into the Sn-containing plating layer. The provision of the Ni plating layer 2*b* is particularly effective when the ground layer is thin. The Sn-containing plating layer 2*c* is provided to improve ease of soldering when mounting the electronic parts on the circuit board.

The Sn plating layer 2*c* is formed as follows. A multiplicity of ceramic elements 1, having been provided with the conductor film 2*a* and the Ni plating layer 2*b* as shown in FIG. 1 is placed in a mesh barrel 4, as shown in FIG. 2. After putting dummies 7 (dummy media balls), the barrel 4 is rotated for electrolytic tin plating in a Sn electrolysis plating bath (Sn electrolytic plating solution) 6, using a cathode 5*a* and an anode 5*b* respectively placed inside and outside of the barrel 4 in the solution. A direct-current power supply 8 is also used. By the resulting lamination of the conductor film 2*a*, the Ni plating layer 2*b*, and the Sn plating layer 2*c*, the external connected electrodes 2 are formed (see JP-A-8-306584, published Nov. 22, 1996).

Consider a Sn electrolytic plating solution of the composition below:

Tin methanesulfonate (soluble stannous salt): 24 g/L in terms of $Sn^{2+}$

Methanesulfonic acid (acid): 65 g/L

Sodium gluconate (complexing agent): 218 g/L

Ascorbic acid (antioxidant for $Sn^{2+}$): 1.5 g/L (here and below, the unit g/L means grams per liter of the solution).

The properties of such a Sn electrolytic plating solution, when used for electrolytic plating performed at an adjusted pH of 4.0 to 4.5, a solution temperature of 25° C., and a deposition rate of 3.0 to 7.0 μm/hour, are not sufficient to meet one or more of the following requirements (i) to (iii):

(i) Improved current efficiency is required to reduce the cost of plating process. This is attained by increasing the critical current density of the Sn electrolytic plating solution and thereby increasing the applicable current value;

(ii) In the Sn electrolytic plating of the chip-shaped electronic parts to be surface-mounted on a circuit board, the Sn plating films of the chip parts adhere together in the barrel. This is known as "sticking" (pairing of the chip-shaped electronic parts). It is known from experience that this "sticking" is influenced by the type of additive used for the Sn plating solution. As such, ingenuity is needed as to which type of additive to use, in order to suppress such "sticking";

(iii) Considering a possible prolonged delay of soldering the electronic parts to the circuit board after forming the Sn plating film on the electronic parts, long-term reliability is needed for solder wettability to ensure sufficient solderability. To this end, time-dependent oxidation of the Sn plating film needs to be prevented. This preferably requires a smooth Sn plating film, so as to reduce the contact area with air.

Traditionally, the additives are not used in such a way as to obtain a Sn electrolytic plating solution that can sufficiently meet all of these requirements in practical applications. Accordingly, there is a need for such a Sn electrolytic plating solution.

SUMMARY OF THE INVENTION

The inventors of the present invention found that all of the foregoing requirements (i) to (iii) can be sufficiently satisfied in practical applications by suitably selecting an additive from nonionic surfactants, which can be used either alone, or more effectively, in combination with a suitably selected cationic surfactant and/or a suitably selected alkyl imidazole. The invention was accomplished based on this finding.

Specifically, the invention provides:

(1) A tin electrolytic plating solution for electronic parts, used for tin electrolytic plating of a ground metal of the electronic parts, the tin electrolytic plating solution comprising:

(a) a soluble stannous salt;

(b) an acid or a salt thereof;

(c) at least one kind of complexing agent selected from a oxycarboxylic acid, polycarboxylic acid, a monocarboxylic acid, and a salt thereof;

(d) an antioxidant for $Sn^{2+}$; and a nonionic surfactant represented by General Formula (I)

(I)

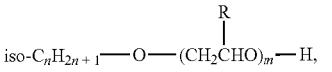

where R represents H or $CH_3$, iso-$C_nH_{2n+1}$ represents a branched alkyl group where n is 8 to 13, and m is 7 to 50, and/or an alkyl imidazole represented by General Formula (II)

(II)

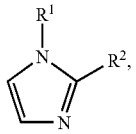

where $R^1$ represents a hydrogen atom or an alkyl group having a carbon number of 1 to 3, and $R^2$ represents an alkyl group having a carbon number of 8 or more, preferably 8 to 16.

(2) A tin electrolytic plating solution for electronic parts, used for tin electrolytic plating of a ground metal of the electronic parts, the tin electrolytic plating solution comprising:

(a) a soluble stannous salt;

(b) an acid or a salt thereof;

(c) at least one kind of complexing agent selected from a oxycarboxylic acid, a polycarboxylic acid, a monocarboxylic acid, and a salt thereof;

(d) an antioxidant for $Sn^{2+}$;

a nonionic surfactant represented by General Formula (I)

(I)

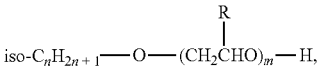

where R represents H or $CH_3$, iso-$C_nH_{2n+1}$ represents a branched alkyl group where n is 8 to 13, and m is 7 to 50; and a cationic surfactant represented by General Formula (III)

(III)

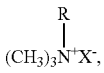

where R represents an alkyl group having a carbon number of 8 to 14, and $X^-$ represents a halogen ion or an anion.

(3) A tin electrolytic plating solution for electronic parts, used for tin electrolytic plating of a ground metal of the electronic parts, the tin electrolytic plating solution comprising:

(a) a soluble stannous salt;

(b) an acid or a salt thereof;

(c) at least one kind of complexing agent selected from a oxycarboxylic acid, a polycarboxylic acid, a monocarboxylic acid, and a salt thereof;

(d) an antioxidant for $Sn^{2+}$;

a nonionic surfactant represented by General Formula (I)

(I)

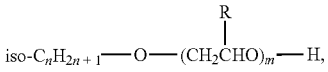

where R represents H or $CH_3$, iso-$C_nH_{2+1}$ represents a branched alkyl group where n is 8 to 13, and m is 7 to 50;

an alkyl imidazole represented by General Formula (II)

(II)

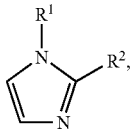

where $R^1$ represents a hydrogen atom or an alkyl group having a carbon number of 1 to 3, and $R^2$ represents an alkyl group having a carbon number of 8 or more, preferably 8 to 16; and a cationic surfactant represented by General Formula (III)

(III)

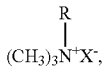

where R represents an alkyl group having a carbon number of 8 to 14, and $X^-$ represents a halogen ion or an anion.

(4) It is preferable in the tin electrolytic plating solutions of (1) through (3) that iso-$C_nH_{2+1}$ in General Formula (I) represent a branched alkyl group having a side chain, where n is 10 to 13.

(5) It is preferable in the tin electrolytic plating solutions of (1) through (3) that iso-$C_nH_{2n+1}$ in General Formula (I) comprise an alkyl chain that is an isodecyl group.

(6) It is preferable in the tin electrolytic plating solution of any one of (1) through (5) that the plating solution contain selected combinations of:

15 to 30 g/L of the component (a), in terms of $Sn^{2+}$;

0.1 to 0.5 mol/L of the component (b);

at least an equimolar amount of the component (c) with respect to $Sn^{2+}$;

0.1 to 10 g/L of the component (d);

1 to 3 g/L of the nonionic surfactant represented by General Formula (I) (as shown in (1), (2), and (3)); and 0.5 to 2 g/L of the alkyl imidazole represented by General Formula (II) (as shown in (1) and (3)); and 0.5 to 1 g/L of the cationic surfactant represented by General Formula (III) (as shown in (2) and (3)), where L denotes liter of the plating solution.

(7) It is preferable in the tin electrolytic plating solution of any one of (1) through (6) that the plating solution contain selected combinations of:

the component (c) and $Sn^{2+}$ at a mole ratio of greater than 2;

the component (d) ranging from 0.5 to 3 g/L;

the nonionic surfactant represented by General Formula (I) ranging from 1 to 3 g/L; and the alkyl imidazole represented by General Formula (II) ranging from 0.5 to 2 g/L.

(8) It is preferable in the tin electrolytic plating solution of any one of (1) through (7) that the pH of the plating solution be adjusted within pKa±1 of the complexing agent contained as the component (c).

(9) It is preferable in the tin electrolytic plating solution of (8) that the complexing agent contained as the component (c) be sodium gluconate, which has a pKa of 3.6, and wherein the pH of the plating solution be adjusted in a range of 2.5 to 4.5 with respect to the pKa 3.6 of the sodium gluconate.

(10) A method for tin electrolytic plating of an electronic part, using the tin electrolytic plating solution for electronic parts of any one of (1) through (9).

(11) A tin electroplated electronic part, which is produced by tin electrolytic plating using the tin electrolytic plating solution for electronic parts of any one of (1) through (9).

(12) A circuit board comprising the tin electroplated electronic part of (11) solder-mounted thereon.

The present invention suitably selects a nonionic surfactant as an additive, which can be used either alone, or more preferably with a suitably selected cationic surfactant and/or a suitably selected alkyl imidazole to provide the following advantages:

(i) The critical current density of the Sn electrolytic plating solution and the applicable current value can be increased to improve current efficiency. This improves productivity and therefore realizes an inexpensive plating process.

(ii) The adhesion or "sticking" of the Sn plating films of the chip parts in the barrel is unlikely. This enables efficient Sn electrolytic plating of the chip parts of the electronic parts surface-mounted on a printed circuit board. The yield is increased as a result.

(iii) A smooth Sn plating film is formed that provides a small contact area with air. This prevents time-dependent oxidation of the Sn plating film. Because solderability does not deteriorate even when the electronic parts are not soldered to a circuit board for extended time periods, long-term reliability is ensured for solder wettability and good solderability is maintained for a long time.

With these advantages (i) to (iii), a Sn plating film having stable properties can be obtained at low cost, making it possible to inexpensively produce electronic parts having good solderability.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 1 is a schematic cross sectional illustration taken at the center of a surface-mounted electronic part.

FIG. 2 is an explanatory, perspective illustration of a barrel electrolysis-plating apparatus.

DESCRIPTION OF THE PREFERRED EMBODIMENT

In the present invention, the soluble stannous salt contained as component (a) may be, for example, stannous salts of inorganic or organic acids including sulfur (S) atoms. Some of the examples are tin sulfate, tin methanesulfonate, and tin sulfamate. The soluble stannous salt should be contained in the appropriate amount of about 15 to 30 g/L, in terms of $Sn^{2+}$. Below this range, deposition efficiency of Sn plating suffers. Above this range, dissolubility suffers and the Sn electrolytic plating solution may not be obtained readily.

The acid or a salt thereof contained as component (b) may be, for example, sulfuric acid, methanesulfonic acid, or sulfamic acid, or sodium salts or other alkali metal salts thereof, or ammonium salts thereof. Preferably, these acids or salts are used in the amount of about 0.1 to 0.5 mol/L. Below this range, a high voltage will be required for the Sn electrolytic plating, which increases the manufacturing cost.

At least one kind of complexing agent selected from an oxycarboxylic acid, a polycarboxylic acid, a monocarboxylic acid, or a salt thereof, contained as component (c), may be, for example, gluconic acid, citric acid, glucoheptonic acid, glucono lactone, or salts thereof. The complexing agent is at least equimolar to $Sn^{2+}$ (complexing agent/$Sn^{2+}$>1), and no greater than $Sn^{2+}$ in terms of solubility. Preferably, complexing agent/$Sn^{2+}$ (mole ratio)>2. A mole ratio below this range leads to poor bath stability and poor anodic dissolution. Above this range, manufacturing cost increases.

The antioxidant for $Sn^{2+}$ contained as component (d) may be, for example, hydroquinone, pyrocatechol, resorcin (aromatic hydroxy compound), ascorbic acid (vitamin C), or hydrazine (amine-based compound). The antioxidant may be contained in a range of about 0.5 to 3 g/L. When the amount of antioxidant is too small, the antioxidant effect will be small. When too large, manufacturing cost increases.

In present invention, the components (a) to (d) are contained in an aqueous solution to provide a base composition for the Sn electrolytic plating solution, which additionally includes a nonionic surfactant represented by General Formula (I) (also referred to as compound (I) hereinafter), or an alkyl imidazole represented by General Formula (II) (also referred to as compound (II) hereinafter).

In General Formula (I), $(CH_2CRHO)_m$ may represent a polycondensate of ethylene glycol, when R is H. When R is $CH_3$, $(CH_2CRHO)_m$ may represent a polycondensate of propylene glycol. When R is H or $CH_3$, $(CH_2CRHO)_m$ may represent a polycondensate of any mole ratio of ethylene glycol and propylene glycol. The polycondensate may be a block polymer, a graft polymer, or any other form of polymer. The degree of polycondensation (m) is 7 to 50. Further, in General Formula (I), iso-$C_nH_{2n+1}$ represents a branched alkyl group, where n=8 to 13. The smoothness of the Sn electrolytic plating film tends to be insufficient when $C_nH_{2n+1}$ is n-$C_nH_{2n+1}$ (n-alkyl group), or when n is less than 8, or m is 51 or greater. When n is 14 or greater, or m is less than 7, solubility suffers and the aqueous, Sn electrolytic plating solution may not be obtained readily.

The compound (I) is used in the amount of about 1 to 3 g/L. When the amount of compound (I) used is too small, the effect of smoothing the Sn electrolytic plating film tends to be insufficient. When too large, manufacturing cost increases.

Though detailed mechanisms are unclear, the "sticking" of the chip parts becomes less likely as the Sn electrolytic plating film becomes smoother. Conceivably, this involves the film-forming mechanism of the nonionic surfactant. Surfactants made of compounds having a sterically large, branched isoalkyl group have the large effects of smoothing the Sn electrolytic plating film. It can therefore be said that such surfactants are less likely to cause "sticking" of the chip parts, as compared with surfactants made of compounds having a n-alkyl group.

In General Formula (II), $R^1$ represents a hydrogen atom or an alkyl group having a carbon number of 1 to 3. $R^2$ represents an alkyl group having a carbon number of 8 or more, preferably 8 to 16. When $R^2$ is a lower alkyl group having a carbon number of less than 8, or a phenyl group, the effect of smoothing the Sn electrolytic plating film will be small. When $R^2$ is a long-chain alkyl group having a carbon number of more than 16, the effect of smoothing the Sn electrolytic plating film will be large but the current efficiency becomes small. However, since the deposited film by the Sn electrolytic plating has desirable smoothness and the occurrence of "sticking" between the chip parts is very small, use of compounds containing such an alkyl group is possible in applications where large critical current density is not required.

The compound (II) may be used in a range of about 0.5 to 2 g/L. When the amount of compound (II) used is too small, the effect of smoothing the Sn electrolytic plating film tends to be insufficient. When too large, manufacturing cost increases.

The compounds (I), (II), and (III) may be individually added to the components (a) to (d). Alternatively, the compounds (I) and (II) may be added together to the components (a) to (d). While this provides the synergistic effect in smoothing the Sn electrolytic plating film, current efficiency may become small.

In the present invention, the Sn electrolytic plating solution may be a six-component aqueous solution containing the components (a) to (d) and the compound (I), and additionally a cationic surfactant represented by General Formula (III) (also referred to as compound (III) hereinafter), or a seven- or eight-component aqueous solution containing the components (a) to (d), the compounds (I) and (III), and additionally the compound (II). By the combination of the compound (I) and the compound (III), the effect of smoothing the Sn electrolytic plating film can be enhanced, from the relatively small level attainable with the use of the latter alone, to the level attainable with the sole use of the former. Further, the smoothing effect is significantly enhanced by the synergistic effect produced by the combination of the compounds (I) and (III) with the compound (II). In this way, the "sticking" of the chip parts can be reduced and the current efficiency can be improved, from the levels that would have been attained by the sole use or other combinations of these compounds.

In General Formula (III), R represents an alkyl group having a carbon number m of 8 to 14. When m is less than 8, the smoothness of the Sn electrolytic plating film tends to be insufficient. When n is 15 or greater, dissolubility suffers, and the aqueous, Sn electrolytic plating solution may not be obtained readily.

The compound (III) may be used in a range of about 0.5 to 1 g/L. When the amount of compound (III) used is too small, the foregoing effect tends to be insufficient. When too large, manufacturing cost increases.

When the Sn electrolytic plating solution is a five-component aqueous solution containing the components (a) to (d) and only the compound (III) but not compound (I), or a six- or seven-component aqueous solution containing the components (a) to (d) and the compounds (III) and (II), the effect of smoothing the Sn electrolytic plating film will be small, and, if there is smoothing effect at all, the critical current density will be low. This shows that the compound (I) plays an important role in exhibiting the effects.

It can be seen from this that the compound (I) (polyoxyethylene (propylene) alkyl ether) having a branched alkyl group with a predetermined carbon number is superior to corresponding polyoxyethylene (propylene) alkyl ethers having a corresponding n-alkyl group, in terms of the effect of smoothing the Sn plating film, and the effect of reducing the "sticking" of the chip parts. It can also be seen that, when used with the compound (III) (cationic surfactant), the compound (I) exhibits distinct effects not obtained when other polyoxyethylene alkyl ethers having a n-alkyl group are used.

Further, when used with the compound (III) and the compound (II) (alkyl imidazole), the compound (I) can improve the smoothness of the Sn plating film and reduce the "sticking" of the chip parts. Further, since it allows for use under high electric current density conditions, the foregoing requirements (i) to (iii) can be satisfied at the same time.

The Sn electrolytic plating solution is an aqueous solution obtained by adding water to a six- or seven-component solution prepared by adding the compound (III) to the five-component mixture containing the components (a) to (d)

and the compound (I), or by adding the compound (III) to a five- or six-component mixture containing the components (a) to (d) and the compound (II). Considering the buffer capability, it is preferable to adjust the pH of the Sn electrolytic plating solution within pKa±1 of the complexing agent contained as component (c). For example, when the complexing agent is sodium gluconate, the pH of the Sn electrolytic plating solution is adjusted to 2.5 to 4.5, with respect to the pKa 3.6 of the sodium gluconate. In this range, higher pH values are preferable. The Sn electrolytic plating solution may be a neutral Sn electrolytic plating solution.

When performing barrel electrolytic plating, the bath temperature of the Sn electrolytic plating solution should be no greater than 30° C., and preferably about 20° C. to 25° C.

EXAMPLES

The following will describe examples of the present invention with reference to FIG. 1 and FIG. 2.

Example 1

By screen printing, a conductor material paste (Ag—Pd powder, 75 parts by weight; ethyl cellulose, 5 parts by weight; terpineol, 20 parts by weight) was applied onto the surfaces at the both ends of the ceramic element 1 shown in FIG. 1. Then, the paste was baked at 800° C. for 10 minutes to form a Ag—Pd printing conductor film 2*a*.

A multiplicity of the ceramic elements 1 with the conductor film 2*a* was then placed in a rotating mesh barrel 4, as shown in FIG. 2 (dummy media balls are added when the number of ceramic elements 1 is too small). Then, nickel electrolytic plating was performed in a nickel plating bath 6, using a cathode 5*a* and an anode 5*b* respectively placed inside and outside of the barrel 4. As a result, a Ni plating film 2*b* was formed, covering the entire portion of the conductor film 2*a* and extending toward the ends of the ceramic element 1 around the edges of the conductor film 2*a*, as shown in FIG. 1.

Separately, Sn electrolytic plating was performed using a similar barrel electrolysis-plating apparatus. As the plating solution, a Sn electrolytic plating solution of the composition below was used. As a result, a Sn plating film 2*c* was formed, as shown in FIG. 1.

| | |
|---|---|
| Tin methanesulfonate (soluble stannous salt) in terms of $Sn^{2+}$ | 24 g |
| Methanesulfonic acid (acid) | 65 g |
| Sodium gluconate (complexing agent) | 218 g |
| Ascorbic acid (antioxidant for $Sn^{2+}$) | 1.5 g |
| Polyoxyethylene isotridecyl ether (additive) | 1.0 to 5.0 g (compound (I)) |
| Water | Remaining part |
| Total | 1 L |

The total volume of the Sn electrolytic plating solution was adjusted to 1 liter by dissolving the components in water. The pH of the Sn electrolytic plating solution was 4.0 to 4.5.

The Sn electrolytic plating solution was placed in a plating tank of the barrel electrolysis-plating apparatus shown in FIG. 2. As the ceramic element 1 provided with the layers of the conductor film 2*a* and the Ni plating film 2*b* shown in FIG. 1, a 212-shaped MLCC (chip part) was used and the conductor film 2*a* and the Ni plating film 2*b* were layered thereon. After ground plating, 100 g of the 212-shaped MLCC was placed in the barrel 4, together with 300 g of steel balls (diameter=1.0 to 1.2 mm). Then, Sn electrolytic plating was performed using direct current, under the following plating conditions: bath temperature 25° C.; deposition rate 3.0 to 7.0 μm/time; welding time 60 minutes.

The chip parts were tested as follows. The results are shown in Table 1.

(i) Evaluation of Sn Electrolytic Plating Film by Solder Paste Method (Antioxidation Property)

The smoothness of the coating (antioxidation property) was evaluated by measuring the zero cross time by a solder paste balancing method (rapid heating mode), using SWET 2100 (Tarutin Kester Corporation) (solder tank temperature 235° C.; EIAJ standard solder paste, Tarutin Kester Corporation). The zero cross time is the time before wetting occurs in the Sn plating film from the start of heating. After Sn electrolytic plating, the chip parts were subjected to an environmental load at 121° C. for 4 hours in an atmosphere of 100% relative humidity (pressure cooker examination). Measurement was made using five of the chip parts, and by taking an average value of the results from these samples. The result of measurement was evaluated according to the following criteria. (The result is shown under "Zero cross time" in Table 1.)

Excellent: Zero cross time less than 1.5 seconds
Good: Zero cross time 1.5 to less than 2.0 seconds
Satisfactory: Zero cross time 2.0 to less than 3.0 seconds
Poor: Zero cross time 3.0 seconds or greater (ii) Percentage of "Sticking" of Chip Parts Concerning all chip parts subjected to the Sn electrolytic plating, the proportion (%) of the chip parts that had the Sn electrolytic plating films adhered to one another was determined. Evaluation was made according to following criteria. (The result is shown under "Percentage of sticking parts" in Table 1.)

Excellent: Less than 1%
Good: 1 to 5%
Average: 6 to 10%
Satisfactory: 11 to 20%
Poor: 21% or greater (iii) Measurement of Current Efficiency Generation of hydrogen under welding current (A) was evaluated according to the criteria below, using a hull cell water tank (267 ml; yamamoto plating set tester), and a brass board (67 mm×100 mm×0.3 mm (thickness); yamamoto plating set tester), under stirrer-stirring at 600 rpm (revolutions per minute). The result is shown under "Current efficiency" in Table 1.

Excellent: No visual indication of hydrogen at 0.3 A
Good: Visual indication of hydrogen at 0.3 A
Satisfactory: Visual indication of hydrogen at 0.2 A
Poor: Strong visual indication of hydrogen at 0.2 A

Examples 2 to 9

Sn electrolytic plating solutions of Examples 2 to 9 were prepared as in Example 1 except that the additives shown in Table 1 were used in the amounts shown, instead of using the polyoxyethylene isotridecyl ether (additive) of Example 1. The pH of the electrolytic plating solutions was 4.0 to 4.5. Sn electrolytic plating was performed as in Example 1, except for using the Sn electrolytic plating solutions of the respective Examples instead of the Sn electrolytic plating solution of Example 1. Tests (i) to (iii) were performed as in Example 1. The results are shown in Table 1.

Reference Examples 1 to 3

Sn electrolytic plating solutions of Reference Examples 1 to 3 were prepared as in Example 1 except that the additives shown in Table 2 were used in the amounts shown, instead of using the polyoxyethylene isotridecyl ether (additive) of Example 1. The pH of the electrolytic plating solutions was 4.0 to 4.5.

Sn electrolytic plating was performed as in Example 1, except for using the Sn electrolytic plating solutions of the respective Reference Examples instead of the Sn electrolytic plating solution of Example 1. Tests (i) to (iii) were performed as in Example 1. The results are shown in Table 2.

Note that, the polyoxyethylene dodecyl ether used in Reference Example 3 may be a compound represented by General Formula (I), except that iso-$C_nH_{2n+1}$ is $C_nH_{2n+1}$. Further, the other additives shown in Tables 1 and 2 may be compounds represented by General Formulae to which they belong.

Comparative Examples 1 to 17

Sn electrolytic plating solutions of Comparative Examples 1 to 17 were prepared as in Example 1 except that the additives shown in Table 3 were used in the amounts shown, instead of using the polyoxyethylene isotridecyl ether (additive) of Example 1. The pH of the electrolytic plating solutions was 4.0 to 4.5.

Sn electrolytic plating was performed as in Example 1, except for using the Sn electrolytic plating solutions of the respective Comparative Examples instead of the Sn electrolytic plating solution of Example 1. Tests (i) to (iii) were performed as in Example 1. The results are shown in Table 3.

Note that, instead of the Ni plating film provided as a ground layer of the Sn plating in the Examples, Reference Examples, and Comparative Examples, a single (plating) film of Ag, Ag—Pd, Ni, or Cu, or a multilayer film (a successive bilayer (plating) film of Ni and Cu, a successive trilayer (plating) film of Ag or Ag—Pd, Ni, and Cu, or the like) may be provided. (The plating film may be electrolytic or electroless, or a combination of both.) The ground of Sn plating is not particularly limited, and the present invention can adopt such an arrangement.

It can be seen from Table 3 that the zero cross time is long and the smoothness of the coating is undesirable and surface oxidation is likely to occur in Comparative Examples 1 to 5, 7 to 10, 11 to 14, and 15 to 20. In Comparative Example 6, the percentage of sticking parts is around 50%, which is very problematic considering the desirable percentage of 3% of less in the foregoing test conditions. Referring to Table 2, the current efficiency is poor in Reference Examples 1, 3, and 4, and the percentage of sticking parts is rather high in Reference Example 2. However, considering the overall sufficiency of the zero cross time, the percentage of sticking parts, and the current efficiency (all satisfying certain levels), it can be said that Reference Examples 1 to 4 are superior to Comparative Examples 1 to 18. Note that, the current efficiency may be small in some applications.

Turning to Table 1, the zero cross time (film smoothness), the percentage of sticking parts, and the current efficiency are all sufficient in Examples 1 to 9, posing no problems in actual applications. Overall, it can be said that Example 9 is by far most desirable, followed by Examples 5 to 8, and Examples 1, 3 and others.

It can be seen from this that the use of nonionic surfactants having a sterically large, branched isodecyl group (Examples 1 to 3) effectively improves the zero cross time (film smoothness), and is effective in reducing the sticking of the Sn electroplated chip parts, by reducing the percentage of sticking parts more than the nonionic surfactants having no branched alkyl group (Comparative Examples 1 to 7).

When the cationic surfactant is used alone (Comparative Examples 8 to 10), the zero cross time (film smoothness) cannot be improved effectively. It might be effective as in Reference Example 1; however, the current efficiency is poor and the critical current density is low.

Further, when the alkyl imidazole is used alone, the effect of improving the zero cross time (film smoothness) varies depending on the chain length of the alkyl group. With the short-chain alkyl group, the effect of improving the zero cross time (film smoothness) is small (Comparative Examples 11 to 13). The effect of improving the zero cross time (film smoothness) is improved by the long-chain alkyl group (Example 4), which, however, lowers current efficiency. Low current efficiency has some applications, however. The deposited film by the Sn electrolytic plating is desirable and the percentage of sticking parts is small, which is advantageous in practical applications.

When the nonionic surfactant and the cationic surfactant are used together, the zero cross time (film smoothness) is not improved when the nonionic surfactant has no branched alkyl group (Comparative Examples 14 to 20). By contrast, when the nonionic surfactants having an isodecyl group are used with an appropriate amount of quaternary ammonium salt, the percentage of sticking parts can be reduced while improving the zero cross time (film smoothness) (Examples 5 to 8).

When the cationic surfactant and the alkyl imidazole are used together (Comparative Examples 17 and 18), the effect of improving the zero cross time (film smoothness) is reduced, as compared with Example 4.

When the nonionic surfactant and the alkyl imidazole are used together (Reference Examples 3 and 4), the effect of improving the zero cross time (film smoothness) is significantly improved, not only when the nonionic surfactant contains a branch alkyl group but when such an alkyl group is not present in the nonionic surfactant. However, current efficiency becomes small in either case.

Further, when the nonionic surfactant, the cationic surfactant, and the alkyl imidazole are used together (Example 9), the zero cross time (film smoothness), the percentage of sticking parts, and the current efficiency can be satisfied at the same time.

Note that, when a nonionic surfactant having no branched alkyl group is used, iso-$C_nH_{2n+1}$ in General Formula (I) is replaced with $C_nH_{2n+1}$.

TABLE 1

| | | Additive | Amount used (g/L) | Zero cross time | Percentage of sticking parts | | Current efficiency |
|---|---|---|---|---|---|---|---|
| Examples | 1 | Polyoxyethylene isotridecyl ether | 3.0 | Satisfactory | 3 to 5 | Good | Good |
| | 2 | Polyoxypropylene isodecyl ether | 1.0 | Good | 15 to 20 | Satisfactory | Average |
| | 3 | Polyoxyethylene isodecyl ether | 1.0 | Good | 15 to 20 | Satisfactory | Good |
| | 4 | 1H-2-Undecyl imidazole | 0.5 | Good | 0.1 to 0.5 | Excellent | Satisfactory |
| | 5 | Polyoxypropylene isodecyl ether | 1.0 | Good | 8 to 10 | Average | Average |
| | | Dodecyl trimethyl ammonium chloride | 0.5 | | | | |
| | 6 | Polyoxyethylene isodecyl ether | 1.0 | Good | 8 to 10 | Average | Good |
| | | Decyl trimethyl ammonium chloride | 0.5 | | | | |
| | 7 | Polyoxyethylene isodecyl ether | 1.0 | Good | 8 to 10 | Average | Good |
| | | Dodecyl trimethyl ammonium chloride | 0.5 | | | | |
| | 8 | Polyoxyethylene isodecyl ether | 1.0 | Satisfactory | 3 to 5 | Good | Good |
| | | Tetradecyl trimethyl ammonium chloride | 0.5 | | | | |
| | 9 | Polyoxyethylene isodecyl ether | 1.0 | Excellent | 1 to 3 | Good | Good |
| | | Decyl trimethyl ammonium chloride | 0.5 | | | | |
| | | 1H-2-Undecyl imidazole | 0.5 | | | | |

TABLE 2

| | | Additive | Amount used (g/L) | Zero cross time | Percentage of sticking parts | | Current efficiency |
|---|---|---|---|---|---|---|---|
| Reference Examples | 1 | Dodecylbenzyl dimethyl ammonium chloride | 0.5 | Excellent | 2 to 3 | Good | Poor |
| | 2 | 1H-2-Undecyl imidazole | 0.5 | Excellent | 3 to 5 | Good | Poor |
| | | Polyoxyethylene isodecyl ether | 1.0 | | | | |
| | 3 | 1H-2-Undecyl imidazole | 0.5 | Excellent | 3 to 5 | Good | Poor |
| | | Polyoxyethylene dodecyl ether | 1.0 | | | | |

TABLE 3

| | | Additive | Amount used (g/L) | Zero cross time | Percentage of sticking parts | | Current efficiency |
|---|---|---|---|---|---|---|---|
| Comparative Examples | 1 | Polyoxyethylene dodecyl ether (number of oxyethylene units = 10) | 1.0 | Poor | 3 to 4 | Good | Good |
| | 2 | Polyoxyethylene dodecyl ether (number of oxyethylene units = 30) | 1.0 | Poor | 3 to 4 | Good | Good |

TABLE 3-continued

| | Additive | Amount used (g/L) | Zero cross time | Percentage of sticking parts | | Current efficiency |
|---|---|---|---|---|---|---|
| 3 | Polyoxyethylene dodecyl amine | 0.5 | Poor | 1 to 3 | Good | Good |
| 4 | Polyoxyethylene stearyl amine | 0.5 | Poor | 1 to 3 | Good | Good |
| 5 | Polyoxyethylene sorbitan monolaurate | 1.0 | Poor | 3 to 4 | Good | Good |
| 6 | Polyoxyethylene distyrenated phenyl ether | 0.3 | Excellent | 48 to 50 | Poor | Satisfactory |
| 7 | Block polymer of polyoxyethylene and polyoxypropylene | 1.0 | Poor | 0.1 to 0.5 | Excellent | Good |
| 8 | Cetylpyridinium chloride | 1.0 | Poor | 0.1 to 0.5 | Excellent | Satisfactory |
| 9 | Dodecyl trimethyl ammonium chloride | 0.5 | Poor | 0.1 to 0.5 | Excellent | Good |
| 10 | Benzyl trimethyl ammonium chloride | 0.5 | Poor | 0.1 to 0.5 | Excellent | Good |
| 11 | 1-Butyl imidazole | 0.5 | Poor | 0.1 to 0.5 | Excellent | Good |
| 12 | 1H-2-Propyl imidazole | 0.5 | Poor | 0.1 to 0.5 | Excellent | Good |
| 13 | 1H-2-Phenyl imidazole | 0.5 | Poor | 0.1 to 0.5 | Excellent | Good |
| 14 | Polyoxyethylene dodecyl ether | 1.0 | Poor | 0.1 to 0.5 | Excellent | Good |
| | Polyoxyethylene dodecyl amine | 0.5 | | | | |
| 15 | Polyoxyethylene dodecyl ether | 1.0 | Poor | 0.1 to 0.5 | Excellent | Good |
| | Dodecyl trimethyl ammonium chloride | 0.5 | | | | |
| 16 | Polyoxyethylene dodecyl ether | 1.0 | Poor | 0.1 to 0.5 | Excellent | Poor |
| | Cetylpyridinium chloride | 1.0 | | | | |
| 17 | 1H-2-Undecyl imidazole | 0.5 | Poor | 0.1 to 0.5 | Excellent | Good |
| | Dodecyl trimethyl ammonium chloride | 0.5 | | | | |
| 18 | 1H-2-Undecyl imidazole | 0.5 | Poor | 0.1 to 0.5 | Excellent | Good |
| | Polyoxyethylene dodecyl amine | 0.5 | | | | |
| 19 | Polyoxypropylene isodecyl ether | 0.1 | Poor | 1 to 3 | Good | Good |
| 20 | 1H-2-Undecyl imidazole | 0.1 | Poor | 0.1 to 0.5 | Excellent | Good |

The embodiment and concrete examples of implementation discussed in the foregoing detailed explanation serve solely to illustrate the technical details of the present invention, which should not be narrowly interpreted within the limits of such embodiment and concrete examples, but rather may be applied in many variations within the spirit of the present invention, as indicated by the scope of the appended claims.

What is claimed is:

1. A tin electrolytic plating solution for electronic parts, comprising:

(a) a soluble stannous salt;

(b) an acid or a salt thereof;

(c) at least one kind of complexing agent selected from an oxycarboxylic acid, a polycarboxylic acid, a monocarboxylic acid, and a salt thereof;

(d) an antioxidant for $Sn^{2+}$;

a nonionic surfactant represented by General Formula (I)

$$\text{iso-}C_nH_{2n+1}-O-(CH_2\overset{\overset{R}{|}}{C}HO)_m-H, \quad \text{(I)}$$

where R represents H or $CH_3$, iso-$C_nH_{2n+1}$ represents a branched alkyl group where n is 8 to 13, and m is 7 to 50;

an alkyl imidazole represented by General Formula (II)

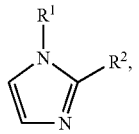

(II)

where $R^1$ represents a hydrogen atom or an alkyl group having a carbon number of 1 to 3, and $R^2$ represents an alkyl group having a carbon number of 8 to 16; and a cationic surfactant represented by General Formula (III)

$$(CH_3)_3\overset{\overset{R}{|}}{N}^+X^-, \quad \text{(III)}$$

where R represents an alkyl group having a carbon number of 8 to 14, and $X^-$ represents a halogen ion or an anion.

2. The tin electrolytic plating solution according to claim 1, wherein, in General Formula (I), iso-$C_nH_{2n+1}$ represents a branched alkyl group having a side chain, where n is 10 to 13.

3. The tin electrolytic plating solution according to claim 1, wherein, in General Formula (I), iso-$C_nH_{2+1}$ comprises an alkyl chain that is an isodecyl group.

4. The tin electrolytic plating solution according to claim 1, wherein the plating solution contains:

15 to 30 g/L of the component (a), in terms of $Sn^{2+}$;

0.1 to 0.5 mol/L of the component (b);

at least an equimolar amount of the component (c) with respect to $Sn^{2+}$;

0.1 to 10 g/L of the component (d);

1 to 5 g/L of the nonionic surfactant represented by General Formula (I);

0.5 to 2 g/L of the alkyl imidazole represented by General Formula (II); and 0.5 to 1 g/L of the cationic surfactant represented by General Formula (III), where L denotes liter of the plating solution.

5. The tin electrolytic plating solution according to claim 4, wherein:

a mole ratio of the component (c) to $Sn^{2+}$ is greater than 2;

the component (d) is 0.5 to 3 g/L; and the nonionic surfactant represented by General Formula (I) is 1 to 3 g/L.

6. The tin electrolytic plating solution according to claim 4, wherein:

the pH of the plating solution is adjusted within pKa±1 of the complexing agent contained as the component (c).

7. The tin electrolytic plating solution according to claim 6, wherein the complexing agent contained as the component (c) is sodium gluconate, which has a pKa of 3.6, and wherein the pH of the plating solution is adjusted in a range of 2.5 to 4.5 with respect to the pKa 3.6 of the sodium gluconate.

8. The tin electrolytic plating solution according to claim 1, which consists essentially of (a) the soluble stannous salt; (b) the acid or salt; (c) the at least one kind of complexing agent; (d) the antioxidant for $Sn^{2+}$; the nonionic surfactant represented by General Formula (I); the alkyl imidazole represented by General Formula (II): and the cationic surfactant represented by General Formula (III) dissolved in water.

* * * * *